US007841119B1

(12) United States Patent
Boyd

(10) Patent No.: US 7,841,119 B1
(45) Date of Patent: Nov. 30, 2010

(54) GUNSTOCK WITH MODULAR INSERT

(76) Inventor: John Randall Boyd, 25376-403RD Ave., Mitchell, SD (US) 57301-5402

( * ) Notice: Subject to any disclaimer, the term of this patent is extended or adjusted under 35 U.S.C. 154(b) by 797 days.

(21) Appl. No.: 11/732,085

(22) Filed: Apr. 2, 2007

(51) Int. Cl.
*F41C 23/00* (2006.01)

(52) U.S. Cl. ..... 42/71.01; 42/75.03

(58) Field of Classification Search ..... 42/71.01, 42/71.02, 72, 73, 75.03, 106
See application file for complete search history.

(56) References Cited

U.S. PATENT DOCUMENTS

| | | | | |
|---|---|---|---|---|
| 3,206,885 | A * | 9/1965 | Dye | 42/75.03 |
| 3,611,607 | A * | 10/1971 | Donnell | 42/106 |
| 3,842,527 | A * | 10/1974 | Low | 42/75.02 |
| 4,312,146 | A * | 1/1982 | Koon, Jr. | 42/75.03 |
| 4,385,464 | A * | 5/1983 | Casull | 42/75.03 |
| 5,228,887 | A | 7/1993 | Mayer | |
| 5,711,102 | A * | 1/1998 | Plaster et al. | 42/71.01 |
| 5,864,978 | A * | 2/1999 | McRary et al. | 42/71.01 |
| 6,256,921 | B1 * | 7/2001 | Howard et al. | 42/71.01 |
| 6,301,817 | B1 | 10/2001 | Hogue et al. | |
| 6,374,528 | B1 * | 4/2002 | Davis et al. | 42/71.01 |
| 6,427,372 | B1 * | 8/2002 | Howard et al. | 42/71.01 |
| 6,487,805 | B1 * | 12/2002 | Reynolds | 42/75.03 |
| 6,637,142 | B1 * | 10/2003 | Reynolds | 42/75.03 |
| 6,651,371 | B2 | 11/2003 | Fitzpatrick et al. | |
| 6,839,998 | B1 | 1/2005 | Armstrong | |
| 6,874,267 | B2 | 4/2005 | Fitzpatrick et al. | |
| 7,152,355 | B2 | 12/2006 | Fitzpatrick et al. | |
| 7,290,366 | B2 * | 11/2007 | Endres | 42/1.11 |
| 7,523,579 | B2 * | 4/2009 | Al-Mulla | 42/71.01 |
| 2004/0211104 | A1 | 10/2004 | Eberle | |
| 2007/0180750 | A1 * | 8/2007 | Al-Mulla | 42/71.01 |

* cited by examiner

*Primary Examiner*—Benjamin P Lee
(74) *Attorney, Agent, or Firm*—Jeffrey A. Proehl; Woods, Fuller, Shultz & Smith, PC

(57) ABSTRACT

A gunstock system is disclosed for use with a gun action and a gun floorplate of a gun. The gunstock system comprises a gunstock having a buttstock portion, a midstock portion, and a forestock portion, with the gunstock defining a cavity. The system further includes an insert assembly removably positionable in the cavity of the gunstock. The insert assembly has a top surface contoured to engage a gun action, and a bottom surface contoured to engage the gun floorplate.

28 Claims, 7 Drawing Sheets

GUNSTOCK WITH MODULAR INSERT

BACKGROUND OF THE INVENTION

1. Field of the Invention

The present invention relates to gunstocks and more particularly pertains to a new gunstock with modular insert for providing a highly versatile gunstock that may be used with a plurality of gun mechanisms by simply changing a modular insert utilized with the gunstock and without having to alter or modify the gunstock to fit the gun mechanism.

2. Description of the Prior Art

Firearms employing gunstocks, such as rifles and shot guns, are extremely popular with hunters and other sportsmen. Since the gunstocks form a large portion of the firearm and also provide the primary point of gripping the firearm by the user when carrying and using the firearm, it has become fairly common to provide the gun owner with a variety of options for gunstocks in both the aftermarket and the original equipment manufacturer (OEM) markets for these firearms and their accessories.

As the gunstocks are a major factor in the appearance of the firearm, as well can enhance the comfort in using the firearm, gunstocks are produced using a variety of different materials and with a variety of different exterior contours. Firearms employing gunstocks are produced by many different manufacturers, with each manufacturer possibly producing several different models using mechanisms with different sizes and shapes. As a result, the variety of different gunstock sizes and shapes and different firearm mechanism configurations results in a multitude of possible combinations of gunstocks that may be needed to be produced to address even a fraction of the gunstock market.

Thus, manufacturers of gunstocks face the dilemma of trying to design, manufacture and maintain an inventory of this multitude of different gunstock permutations (which can be expensive) or simply manufacture the gunstocks on an as-needed basis (which can cause delays in supplying the customer as well as the various outlets with the particular style of gunstock).

Therefore it is believed that there is a need for a gunstock system that may be used with a plurality of different gun mechanisms, or that may be readily adaptable for use with different gun mechanisms.

SUMMARY OF THE INVENTION

In view of the foregoing disadvantages inherent in the known types of gunstocks now present in the prior art, the present invention provides a new gunstock with modular insert wherein the same can be utilized for providing a highly versatile gunstock that may be used with a plurality of gun mechanisms by simply changing a modular insert utilized with the gunstock and without having to alter or modify the gunstock to fit the gun mechanism.

To attain this, in one aspect the present invention generally comprises a gunstock system for use with a gun action and a gun floorplate of a gun. The gunstock system comprises a gunstock having a buttstock portion, a midstock portion, and a forestock portion, with the gunstock defining a cavity. The system further includes an insert assembly removably positionable in the cavity of the gunstock. The insert assembly has a top surface contoured to engage a gun action, and a bottom surface contoured to engage the gun floorplate.

In another aspect of the invention, the present invention generally comprises a gunstock system for use with a gun action and a gun floorplate of a gun. The system comprises a gunstock having a buttstock portion, a midstock portion, and a forestock portion. The buttstock, midstock, and forestock portions are unified as a single unit. The gunstock defines a cavity configured to removably receive an insert assembly, and is located in the midstock portion of the gunstock. The gunstock has an upper surface and a lower surface, with the cavity extending into the upper surface of the gunstock and into the lower surface of the gunstock.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

One significant advantage of the present invention is the ability to accommodate gun mechanisms of various shapes and sizes on one gunstock configuration by utilizing a variety of different inserts that are customized to the various shapes and sizes of different gun mechanisms.

Further advantages of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects of the invention will become apparent when consideration is given to the following detailed description thereof. Such description makes reference to the annexed drawings wherein.

DESCRIPTION OF PREFERRED EMBODIMENTS

Figure 1:
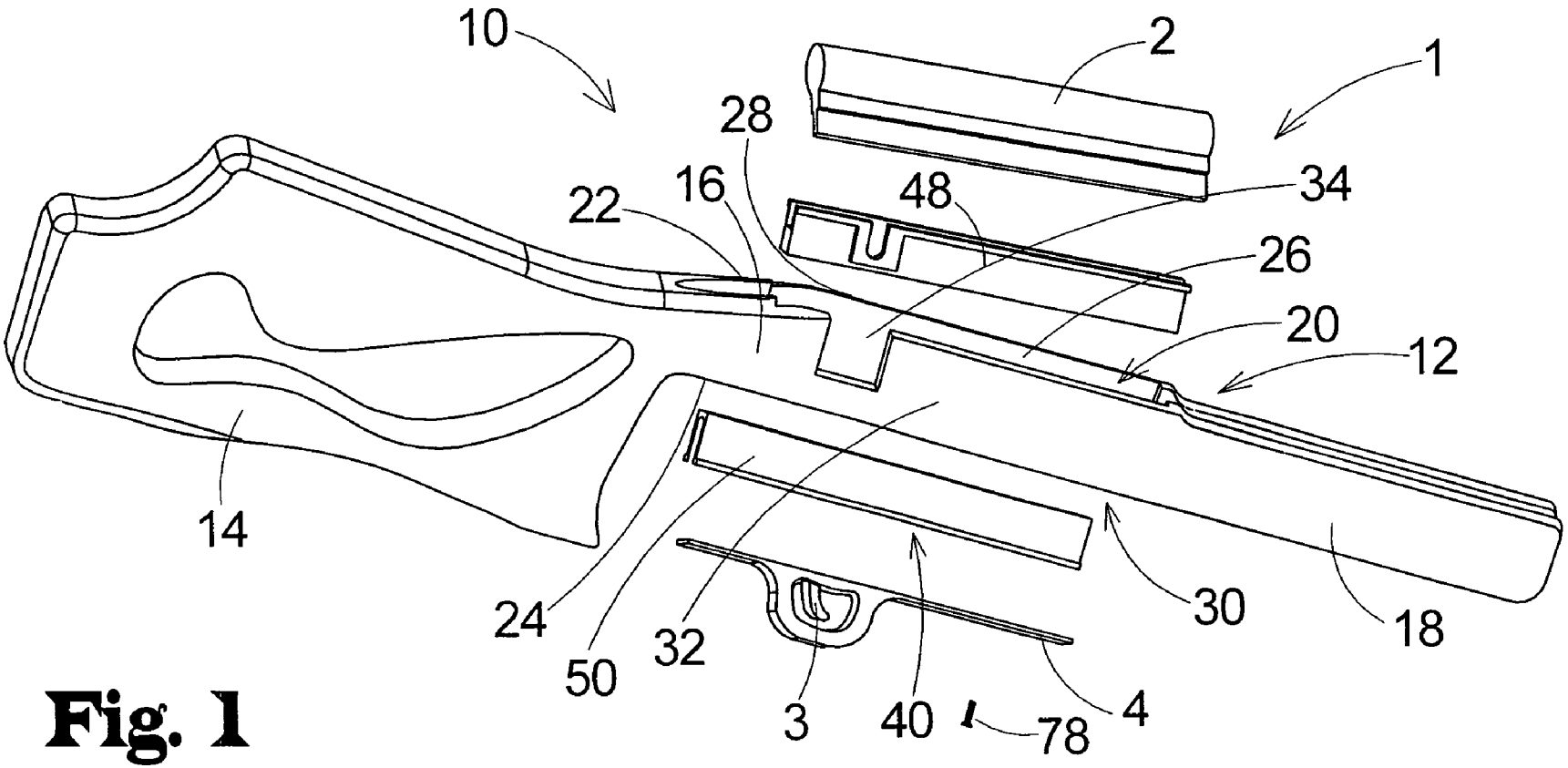
FIG. 1 is a schematic exploded perspective view of a new gunstock with modular insert according to the present invention.
Figure 2:
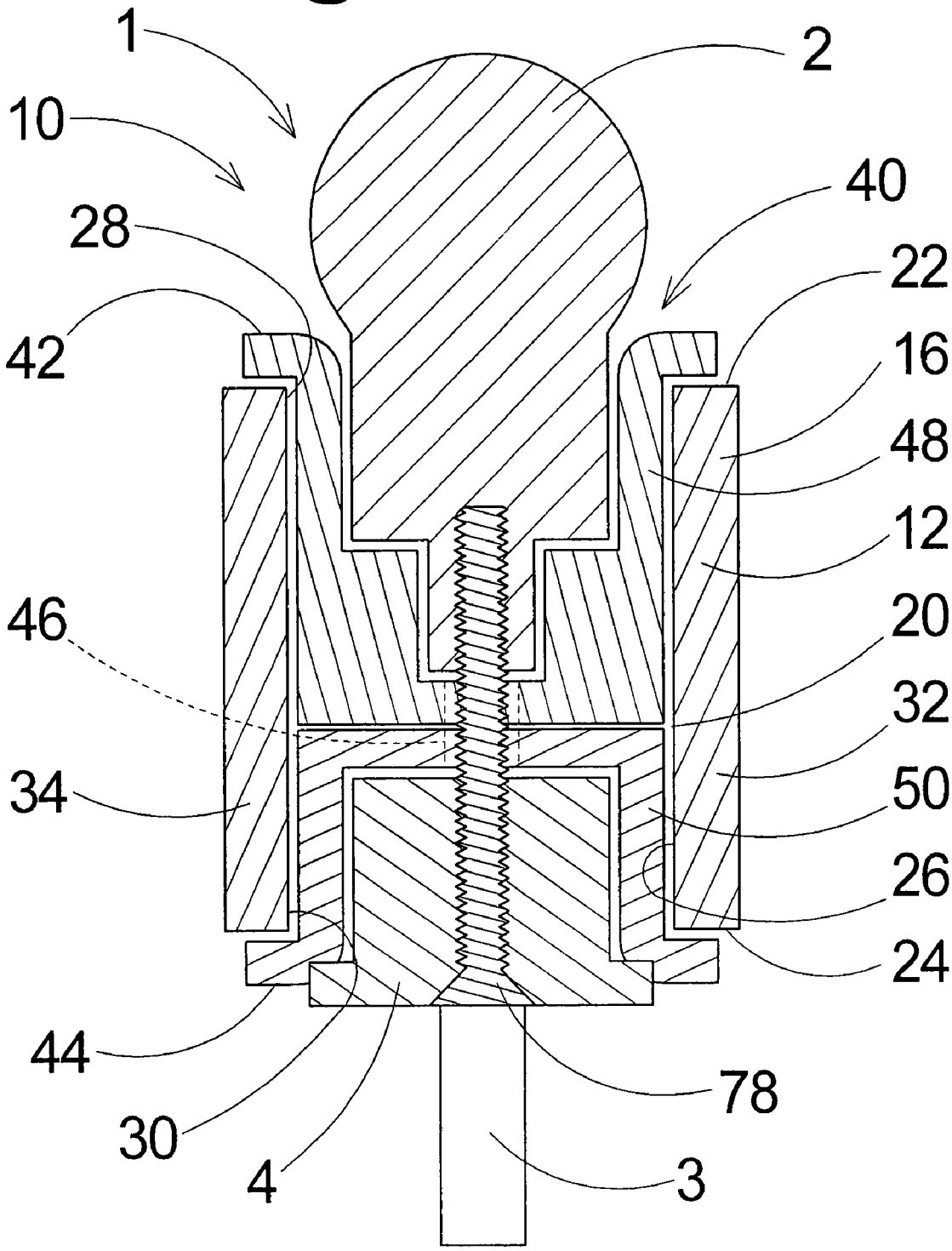
FIG. 2 is a schematic sectional view of one configuration of the present invention shown in relation to various mechanisms of a gun.
Figure 3:
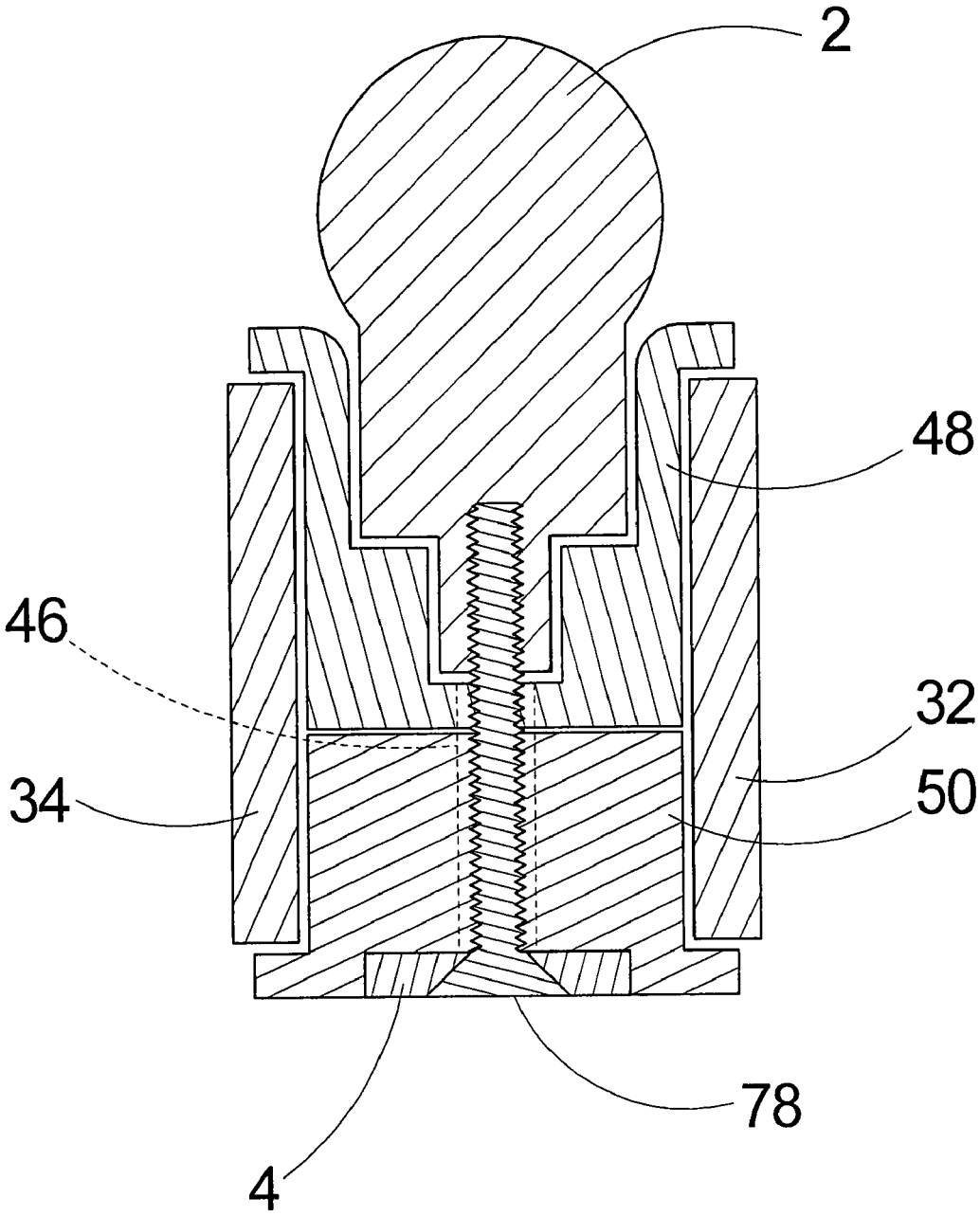
FIG. 3 is a schematic sectional view of another configuration the present invention in relation to various mechanisms of a gun.

With reference now to the drawings, and in particular to FIGS. 1 through 7 thereof, a new gunstock with modular insert embodying the principles and concepts of the present invention and generally designated by the reference numeral 10 will be described.

As best illustrated in FIGS. 1 through 7, the gunstock 10 with modular insert generally comprises a gunstock 12 with a cavity 20, and an insert assembly 40 that is positionable in the cavity of the gunstock.

The invention comprises a gunstock system 10 for use with various mechanisms of a gun 1 to form a complete gun 1. The most suitable types of guns 1 for the practice of the invention employ gunstocks on which parts of the gun may be mounted, such as, for example rifles and shotguns. The gun 1 may include a gun action 2 incorporating a receiver and a trigger 3, and may include a gun floorplate 4 incorporating a trigger guard 5.

The gunstock system 10 of the invention includes a gunstock 12 that includes a buttstock portion 14 located toward the rear end of the stock, a midstock portion 16 positioned toward a middle of the stock, and a forestock portion 18 positioned toward a front of the stock. In the most preferred embodiments of the invention, the buttstock 14, midstock 16, and forestock 18 portions of the gunstock 12 are unified as a single unit, and are not separable from each other without severing or breaking the material from which the gunstock is formed. In some embodiments, the buttstock 14, midstock 16, and forestock 18 portions may be formed of a single piece of material, such as a single piece of wood or a single piece of molded plastic, although it is contemplated that the portions could be separately formed and then adhered together to form the single, unified piece.

Significantly, the gunstock 12 defines a cavity 20. In some embodiments, the cavity 20 is located in the midstock portion 14 of the gunstock 12, but it is contemplated that the cavity may extend partially into the buttstock 14 and forestock 18 portions of the stock. The cavity 20 may extend through the gunstock 12, although it is contemplated that in some embodiments the cavity may not extend completely through the gunstock. The gunstock 12 may have an upper surface 22 and a lower surface 24, and the cavity 20 may extend through the gunstock from the upper surface 22 to the lower surface 24. The cavity 20 may be defined by a cavity surface 26 on the gunstock 12. The cavity 20 may extend between an upper opening 28 in the upper surface 22 of the gunstock 12 and a lower opening 30 in the lower surface 24 of the gunstock. The midstock portion 16 of the gunstock 12 adjacent to the cavity may comprise a pair of side wall structures 32, 34 that are located on opposite sides of the cavity 20.

The cavity 20 may have a substantially rectangular cross section in a plane that is oriented transverse to an axis of the cavity 20 that extends between the upper opening 28 in the upper surface 22 and the lower opening 30 in the lower surface 24. In other embodiments, the cavity 20 may be elongated with rounded ends. Other shapes and configurations may also be utilized.

Another significant aspect of the invention is an insert assembly 40 that is removably mountable on the gunstock 12 for engaging various elements of the gun mechanism. The insert assembly 40 may be removably positioned in the cavity 20 of the gunstock 12. The insert assembly 40 may have a top surface 42 that is contoured to engage the surface of the gun action 2. The insert assembly 40 may also have a bottom surface 44 that is contoured to engage the gun floorplate 3. The particular contouring and shaping of the top surface 42 and the bottom surface 44 will vary from one gun mechanism to another gun mechanism, and preferably the contouring of the top surface 42 is relatively closely complementary to the gun action 2 for which it is intended to be used, and similarly the contouring of the bottom surface 44 is relatively closely complementary to the gun floorplate 4. It should be recognized that not exact correspondence between the surfaces of the insert assembly 40 and the shape of the parts of the gun mechanism are required, and only a degree of contouring sufficient to adequately support the parts of the gun is needed.

The insert assembly 40 may include at least one aperture 46 that extends through the insert assembly for receiving a trigger assembly (or other structure of the gun mechanism) therethrough. The aperture 46 may extend from the top surface 42 of the insert assembly 40 to the bottom surface 44 of the insert assembly, thus effectively passing through the insert assembly. Optionally, more than one aperture 46 may be formed in the insert assembly for receiving, for example, fasteners for the gun mechanism.

In some embodiments, the insert assembly 40 may be bifurcated and includes an upper insert 48 and a lower insert 50. The upper insert 48 may be inserted through the upper opening 28 in the gunstock and the lower insert 50 may be inserted through the lower opening 30 in the gunstock 12. The upper insert 48 may include the top surface 42 of the insert assembly 40 that is contoured to engage the gun action (or other structure of the gun). The lower insert 50 may include the bottom surface 44 of the insert assembly 40 that is contoured to engage the gun floorplate (or other structure of the gun). The upper 48 and lower 50 inserts may be positionable in the cavity 20 in an adjacent relationship. The upper 48 and lower 50 inserts may contact each other when positioned in the cavity 20, which can provide a more secure seating of the inserts, or may be spaced from each other with a gap therebetween when positioned in the cavity 20.

Figure 4:
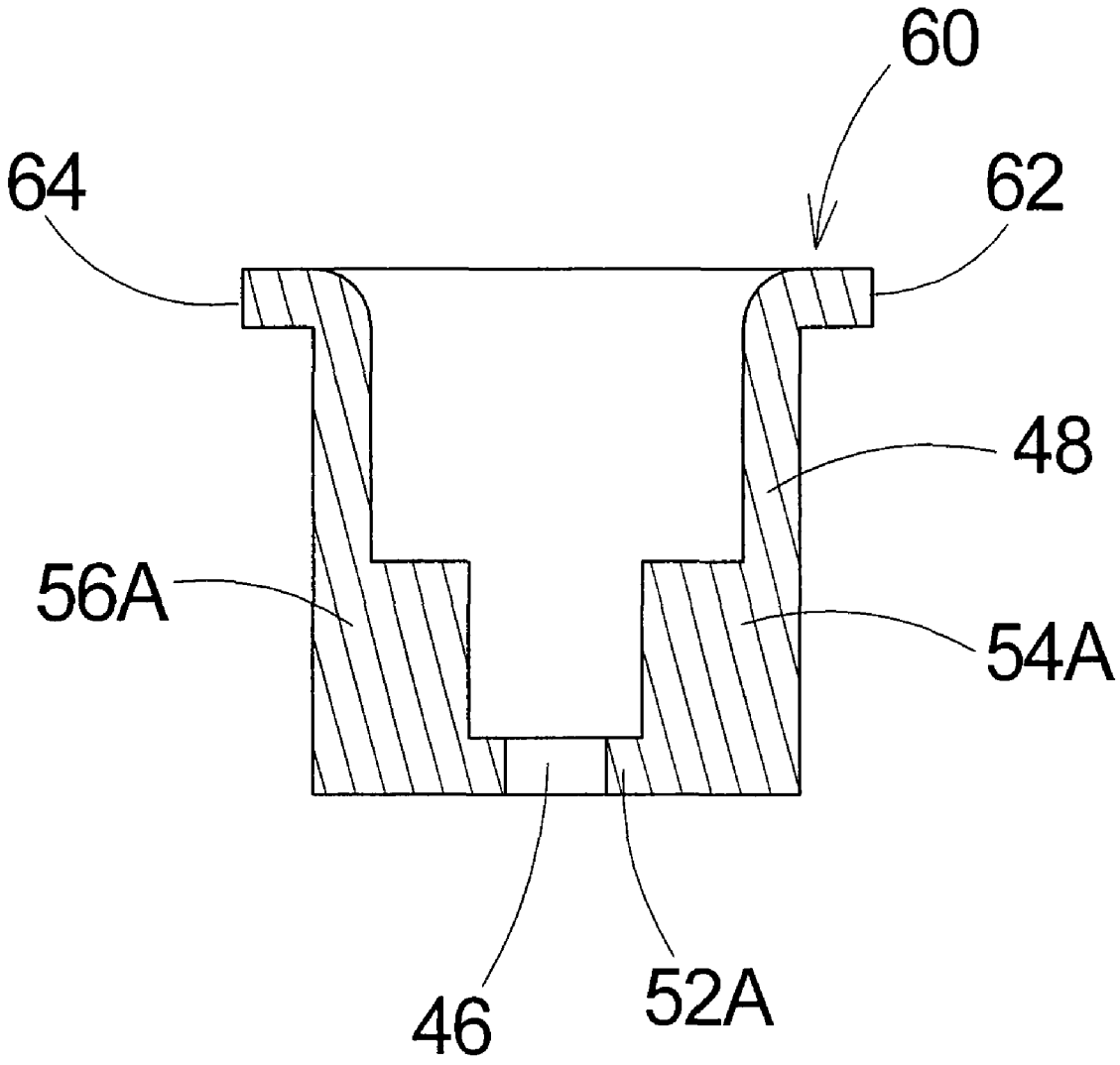
FIG. 4 is a schematic sectional view of the upper insert of the present invention.
Figure 5:
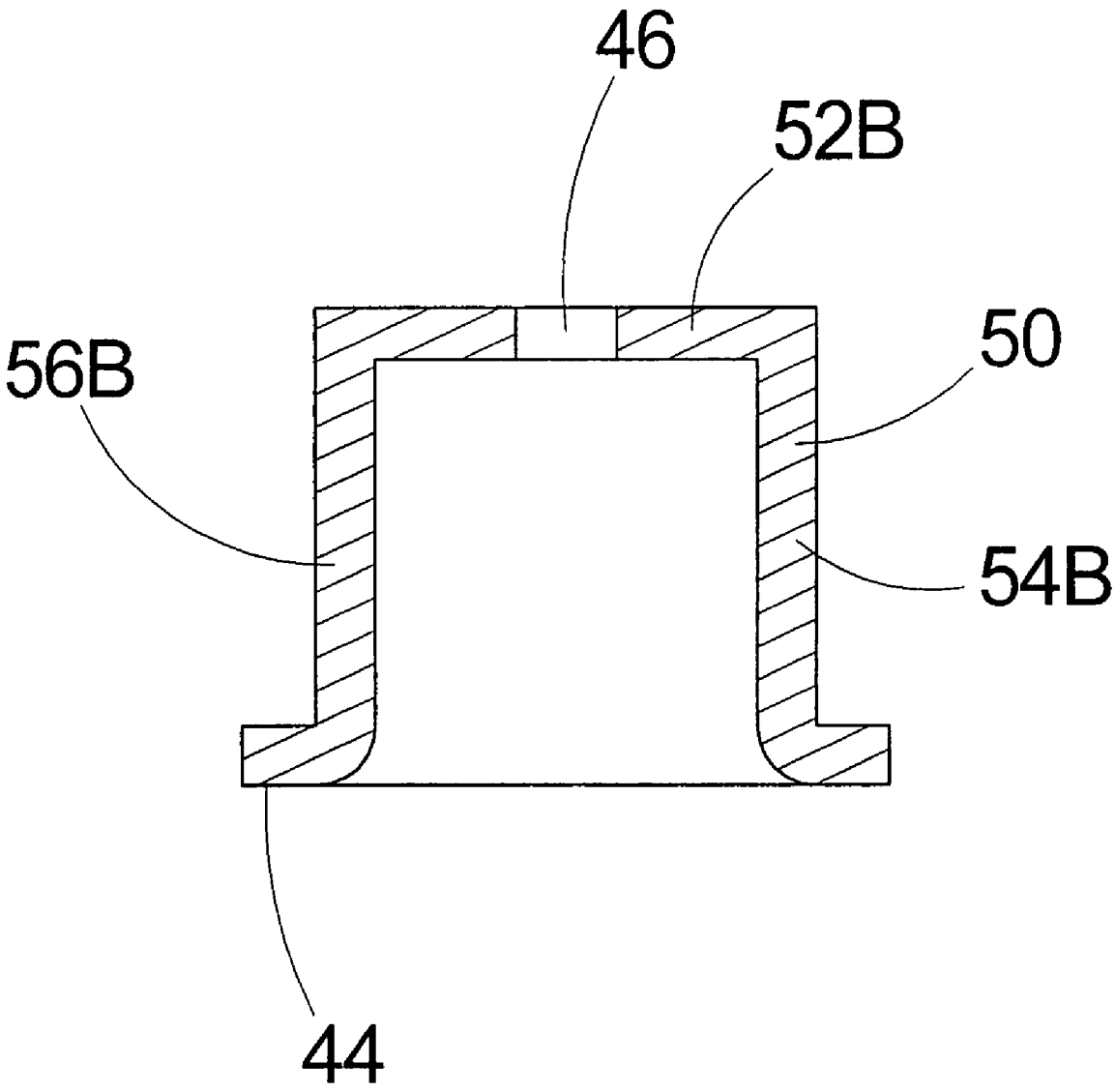
FIG. 5 is a schematic sectional view of the lower insert of the present invention.
Figure 6:
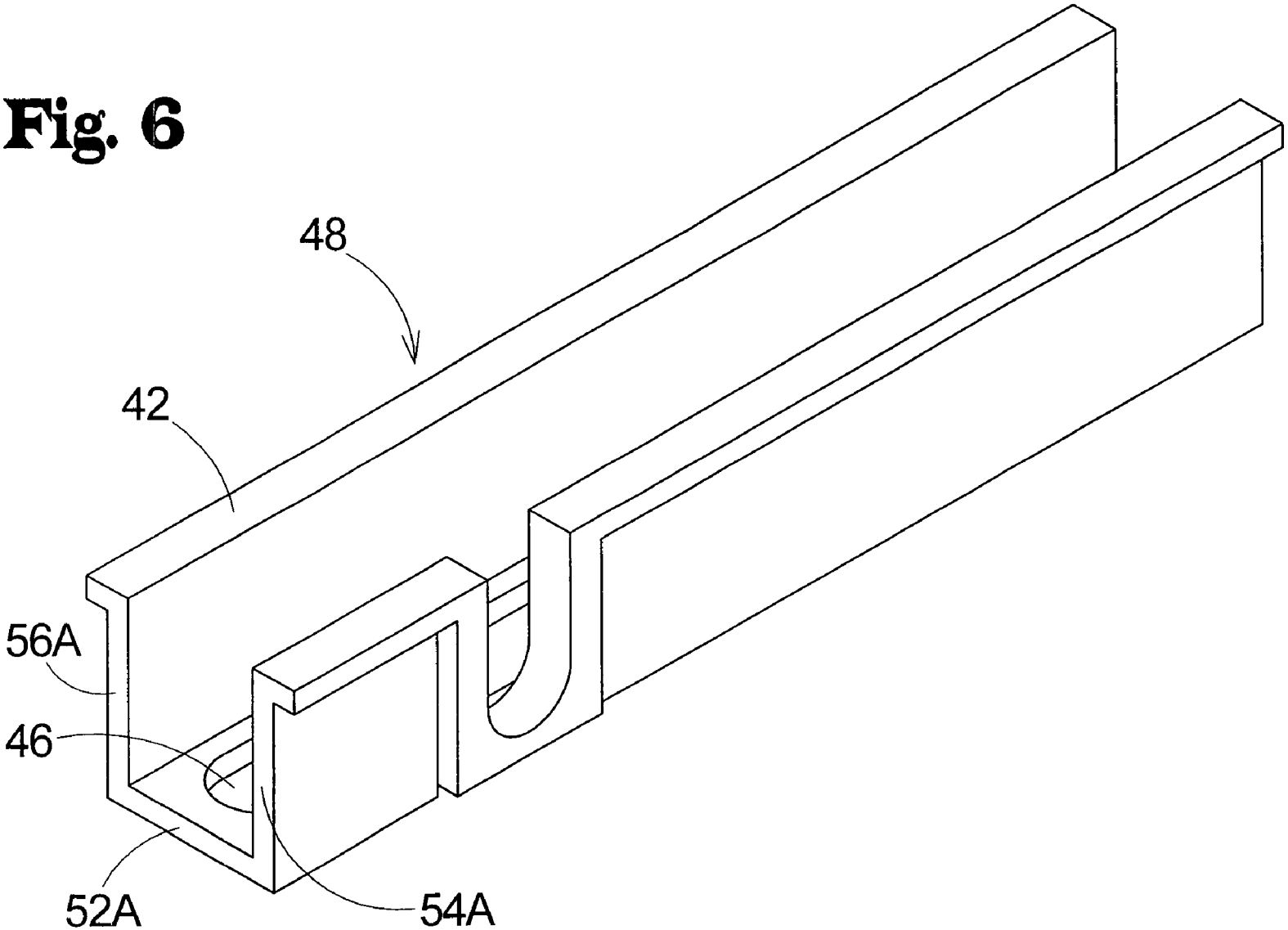
FIG. 6 is a schematic perspective view of the upper insert of the present invention.
Figure 7:
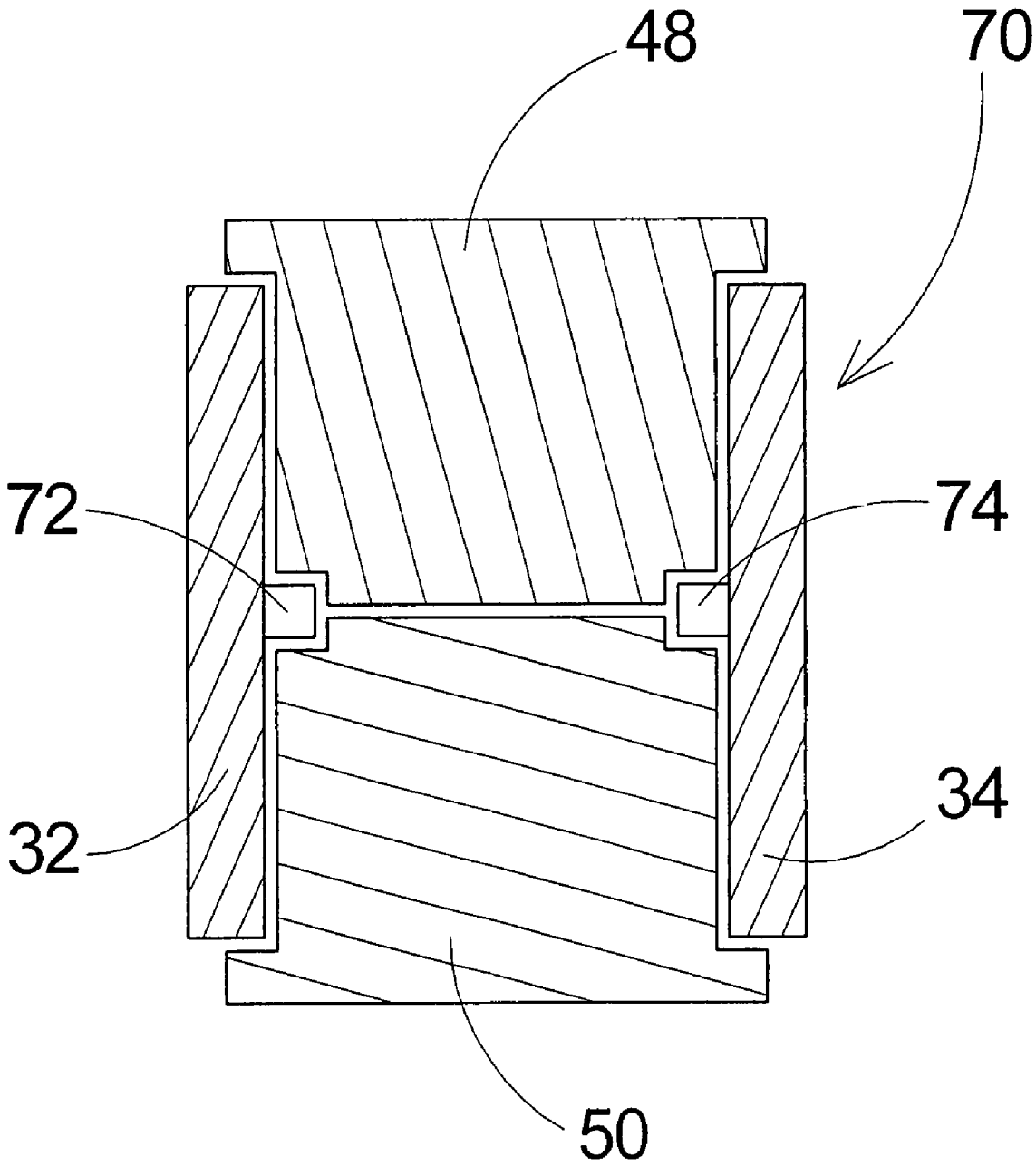
FIG. 7 is a schematic sectional view of the present invention showing an optional securing structure configuration.

At least one of the inserts 48, 50 may have a substantially channel-shaped configuration in some configurations. The substantially channel-shaped insert configuration may include a base section 52 and a pair of wing sections 54, 56 that extend from the base section 52. As shown in FIGS. 4 and 5 of the drawings, the upper insert 48 has a base section 52A and wing sections 54A and 56A and the lower insert 50 has base section 52B and wing sections 54B and 56B. Each of the wing sections 54, 56 may extend in a substantially parallel orientation to each other, and each of the wing sections 54, 56 may extend in a substantially perpendicular relationship to the base section 52. In some embodiments of the insert assembly 40, each of the inserts 48, 50 may have the substantially channel-shaped configuration, and the substantially channel-shaped inserts may be positionable in a substantially opposite orientations to each other in the cavity 20. The base sections 52 of the inserts 48, 50 may be positionable adjacent to each other in the cavity 20.

At least one, and in some embodiments both, of the inserts 48, 50 have a securing structure 60 that is configured to help secure the respective insert to the gunstock when the insert is inserted into the cavity 20. The securing structure 60 may comprise at least one shoulder 62 formed on the insert 48, 50 that is configured to engage the gunstock 12 at a location adjacent to a respective opening 28, in the gunstock when the insert 48 is positioned in the cavity 20. The securing structure 60 may comprise a pair of shoulders 62, 64 formed on the insert 48, 50 that are configured to engage the gunstock 12 at a location adjacent to the respective opening 28, 30 in the gunstock. The pair of shoulders 62, 64 may extend in substantially opposite directions such that the shoulders engage substantially opposite locations on the gunstock 12 adjacent to the respective opening 28, 30. The shoulder or shoulders may function to prevent the respective insert from moving through the cavity 20, while still permitting the insert to be moved into and positioned in the cavity.

In an optional embodiment of the invention, a securing structure 70 may be formed on the cavity surface 26 of the gunstock 12. The securing structure may comprise a protrusion 72 on the cavity surface 26 that extends from the cavity surface 26 into the cavity 20. The protrusion 72 of the securing structure 70 may be configured to be engaged by at least one of the upper 48 and lower 50 inserts when the upper and lower inserts are positioned in the cavity 20 such that when the upper and lower inserts are fastened together, at least one of the inserts 48, 50 is secured in the cavity. The protrusion 72 may be positioned between the upper 48 and lower 50 inserts when the upper and lower inserts are positioned in the cavity. As a further option, a pair 72, 74 of protrusions may be employed, and the pair 72, 74 of protrusions may be positioned in a substantially opposed relationship to each other.

At least one fastener 78, and optionally two or more fasteners, may be extended through the aperture 46 in the insert assembly 40, and thus may be extended through the upper insert 48 and through the lower insert 50 to secure parts of the gun to the gunstock 12. In securing the parts of the gun mechanism to the gunstock, the fastener 78 or fasteners may be utilized to secure the upper 48 and lower 50 inserts together and in position in the cavity 20. For example, the fastener 78 may connect the gun action 2 and the floorplate 4 together, with the inserts 48, 50 being positioned between the action 2 and the floorplate 4 to hold the inserts between the parts of the gun mechanism. Optionally, the fastener may be used to simply connect the upper 48 and lower 50 inserts together without passing through parts of the gun mechanism.

In use, an insert assembly 40 may be selected with suitable contouring on the top surface 42 for use with the gun action 2 and suitable contouring on the bottom surface 44 for use with the floorplate 4 of the gun that is to utilize the gunstock. The insert assembly 40 is inserted into the cavity 20, and in embodiments in which the upper 48 and lower 50 inserts are employed, the upper insert may be moved through the upper opening 28 into the cavity, and the lower insert may be moved through the lower opening 30 into the cavity, until the inserts are seated in the cavity, either with the shoulders 62, 64 being rested against the respective surface of the gunstock or with the protrusions 72, 74 positioned between the inserts. The gun action 2 may be positioned against the top surface 42 of the insert assembly and the gun floorplate 4 may be positioned against the bottom surface of the insert assembly. A fastener 78 or fasteners may be extended between the floorplate 4 and the action 2 through inserts 48, 50 to hold the action 2 and floorplate 4 to the insert assembly 40 and the gunstock 12.

With respect to the above description then, it is to be realized that the optimum dimensional relationships for the parts of the invention, to include variations in size, materials, shape, form, function and manner of operation, assembly and use, are deemed readily apparent and obvious to one skilled in the art in light of the foregoing disclosure, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A gunstock system for use with a gun action and a gun floorplate of a gun, the system comprising:

a gunstock having a buttstock portion, a midstock portion, and a forestock portion, the gunstock defining a cavity; and an insert assembly removably positionable in the cavity of the gunstock, the insert assembly having a top surface contoured to engage a gun action, the insert assembly having a bottom surface contoured to engage the gun floorplate;

wherein the insert assembly comprises an upper insert and a lower insert, the upper insert being removably positioned above the lower insert in the cavity when the inserts are inserted into the gunstock.

2. The gunstock system of claim 1 wherein the buttstock, midstock, and forestock portions are unified as a single unit.

3. The gunstock system of claim 1 wherein the cavity is located in the midstock portion of the gunstock.

4. The gunstock system of claim 1 wherein the cavity extends through the gunstock.

5. The gunstock system of claim 1 wherein the upper insert has the top surface contoured to engage the gun action, the lower insert having a bottom surface contoured to engage the gun floorplate.

6. The gunstock system of claim 1 wherein the gunstock includes an upper opening into the cavity and a lower opening into the cavity; and wherein the upper insert is insertable through the upper opening in the gunstock and the lower insert being insertable through the lower opening in the gunstock.

7. The gunstock system of claim 1 wherein the upper and lower inserts are positionable adjacent to each other in the cavity.

8. The gunstock system of claim 1 wherein at least one of the upper and lower inserts has a substantially channel-shaped configuration.

9. The gunstock system of claim 1 wherein each of the upper and lower inserts has the substantially channel-shaped configuration, the substantially channel-shaped inserts being positionable in the cavity such that openings of the channel-shaped inserts open in substantially opposite orientations.

10. The gunstock system of claim 1 wherein at least one securing structure is formed on a cavity surface defining the cavity in the gunstock.

11. The gunstock system of claim 10 wherein the at least one securing structure comprises a protrusion extending from the cavity surface into the cavity.

12. The gunstock system of claim 1 wherein at least one of the inserts has a securing structure configured to secure the insert to the gunstock when the insert is inserted into the cavity, the securing structure comprising at least one shoulder on the insert configured to engage the gunstock adjacent to the upper opening in the gunstock when the insert is positioned in the cavity.

13. The gunstock system of claim 1 wherein the gunstock includes an upper opening into the cavity, the upper insert being removably insertable in the upper opening and into the cavity; and wherein at least one shoulder is formed on the upper insert and is configured to engage an upper surface of the gunstock adjacent to the upper opening in the gunstock when the upper insert is inserted in the cavity.

14. The gunstock system of claim 13 wherein the at least one shoulder comprises a pair of shoulders that extend in substantially opposite directions for engaging substantially opposite locations on the upper surface of the gunstock adjacent to the upper opening.

15. The gunstock system of claim 1 wherein at least one aperture extends through the insert assembly for receiving a trigger assembly therethrough.

16. The gunstock system of claim 1 wherein the top surface of the insert assembly is contoured to abut against the gun action and the bottom surface is contoured to abut the gun floorplate.

17. The gunstock system of claim 1 wherein the gunstock has an upper surface and a lower surface; and the upper insert being located relatively closer to the upper surface of the gunstock than the lower insert when the insert assembly is positioned in the cavity, and the lower insert being located relatively closer to the lower surface of the gunstock than the upper insert when the insert assembly is positioned in the cavity.

18. The gunstock system of claim 1 wherein the gunstock has an upper surface with an upper opening into the cavity and a lower surface with a lower opening into the cavity;

and wherein the upper insert is insertable into the cavity through the upper opening and the lower insert is insertable into the cavity through the lower opening to position the upper and lower inserts in a vertically adjacent relationship.

19. The gunstock system of claim 1 wherein the upper insert engages the upper surface of the gunstock when inserted into the cavity and the lower insert engages the lower surface of the gunstock when inserted into the cavity.

20. A gunstock system for use with a gun action and a gun floorplate of a gun, the system comprising:

a gunstock having a buttstock portion, a midstock portion, and a forestock portion, the buttstock, midstock, and forestock portions are unified as a single unit;

wherein the gunstock defines a cavity configured to removably receive an insert assembly, the gunstock having an upper surface and a lower surface, the cavity extending through the midstock portion to form an upper opening in the upper surface of the gunstock and an opening in the lower surface of the gunstock, the cavity being configured to receive an upper insert through the upper opening and a lower insert through the lower opening so that the upper insert is positioned above the lower insert in the cavity;

wherein at least one securing structure is formed on a cavity surface defining the cavity in the gunstock;

wherein the at least one securing structure comprises a protrusion extending from the cavity surface into the cavity; and additionally comprising an insert assembly including an upper insert and a lower insert, and wherein the protrusion is configured to be engaged by at least one of the upper and lower inserts when the upper and lower inserts are positioned in the cavity such that when the upper and lower inserts are fastened together at least one of the inserts is secured in the cavity.

21. A gunstock system for use with a gun action and a gun floorplate of a gun, the system comprising:

a gunstock having a buttstock portion, a midstock portion, and a forestock portion, the buttstock, midstock, and forestock portions are unified as a single unit;

wherein the gunstock defines a cavity configured to removably receive an insert assembly, the gunstock having an upper surface and a lower surface, the cavity extending through the midstock portion to form an upper opening in the upper surface of the gunstock and an opening in the lower surface of the gunstock, the cavity being configured to receive an upper insert through the upper opening and a lower insert through the lower opening so that the upper insert is positioned above the lower insert in the cavity; and an insert assembly removably positioned in the cavity of the gunstock, the insert assembly comprising an upper insert configured to be inserted through the upper opening into the cavity and a lower insert configured to be inserted through the lower opening into the cavity.

22. The gunstock system of claim 21 wherein the upper insert has a top surface contoured to engage a gun action and the lower insert has a bottom surface contoured to engage the gun floorplate.

23. The gunstock system of claim 21 wherein the gunstock has a protrusion extending from the cavity surface into the cavity, wherein one of the upper and lower inserts engages the protrusion when the inserts are inserted into the cavity.

24. The gunstock system of claim 21 wherein at least one shoulder is formed on the upper insert and is configured to engage the upper surface of the gunstock when the upper insert is inserted in the cavity.

25. The gunstock system of claim 24 wherein the at least one shoulder comprises a pair of shoulders that extend in substantially opposite directions for engaging substantially opposite locations on the upper surface of the gunstock adjacent to the upper opening.

26. The gunstock system of claim 21 wherein at least one shoulder is formed on the lower insert and is configured to engage the lower surface of the gunstock when the lower insert is inserted in the cavity.

27. The gunstock system of claim 26 wherein the at least one shoulder comprises a pair of shoulders that extend in substantially opposite directions for engaging substantially opposite locations on the lower surface of the gunstock adjacent to the lower opening.

28. A gunstock system for use with a gun action and a gun floorplate of a gun, the system comprising:

a gunstock having a buttstock portion, a midstock portion, and a forestock portion, the gunstock defining a cavity; and an insert assembly removably positionable in the cavity of the gunstock, the insert assembly having a top surface contoured to engage a gun action, the insert assembly having a bottom surface contoured to engage the gun floorplate;

wherein at least one securing structure is formed on a cavity surface defining the cavity in the gunstock;

wherein the at least one securing structure comprises a protrusion extending from the cavity surface into the cavity; and wherein the insert assembly comprises an upper insert and a lower insert, and wherein the protrusion is configured to be engaged by at least one of the upper and lower inserts when the upper and lower inserts are positioned in the cavity such that when the upper and lower inserts are fastened together at least one of the inserts is secured in the cavity.

* * * * *